United States Patent [19]

Wahle et al.

[11] Patent Number: 4,484,591

[45] Date of Patent: Nov. 27, 1984

[54] METHOD OF TESTING AND CLASSIFYING CIGARETTES OR THE LIKE

[75] Inventors: Günter Wahle, Reinbek; Willi Filter, Hamburg, both of Fed. Rep. of Germany

[73] Assignee: Hauni-Werke Körber & Co. KG., Hamburg, Fed. Rep. of Germany

[21] Appl. No.: 363,394

[22] Filed: Mar. 29, 1982

[30] Foreign Application Priority Data

Apr. 18, 1981 [DE] Fed. Rep. of Germany ..... 3115021

[51] Int. Cl.[3] ..... A24C 5/34; A24C 5/345

[52] U.S. Cl. ..... 131/280; 131/282; 131/908

[58] Field of Search ..... 131/907, 908, 909, 282, 131/280, 84 R

[56] References Cited

U.S. PATENT DOCUMENTS 4,403,619 9/1983 Dahlgrun ..... 131/907

4,403,620 9/1983 Joseph et al. ..... 131/907

*Primary Examiner*—V. Millin

*Attorney, Agent, or Firm*—Peter K. Kontler

[57] ABSTRACT

Plain or filter cigarettes are tested at a first station by two or more testing devices each of which monitors the cigarettes for the presence or absence of a particular defect. The testing devices generate defect signals which are delayed by shift registers so as to ensure that the delayed defect signals are transmitted to a segregating mechanism which removes defective cigarettes from a path that is common to the satisfactory and defective cigarettes and delivers defective cigarettes to selected receptacles which are installed at a second station and each of which gathers only cigarettes exhibiting a particular defect. Actuation of a switch entails the removal of a selected number of samples from the common path for satisfactory and defective cigarettes, and such samples are gathered in an additional receptacle at the second station.

19 Claims, 6 Drawing Figures

A2
P2
133.0
103a
103b
132.0
130
124.2
125.2
123b
124b
124.ℓ
132b
133b
116b
143b
87
86
125.3
124.3
123c
124c
126b
132c
133c
116c
143c
89
88
125.4
124.4
123d
124d
126c
132d
133d
116d
143d
92
91
125.5
126d
124.5
123e
124e
132e
133e
116e
143e
94
93
126e
123a
d
132a
133a
116a
142a
a
c
b
141a
138
137
124a
126a
134
136
131
128
129
127

METHOD OF TESTING AND CLASSIFYING CIGARETTES OR THE LIKE

BACKGROUND OF THE INVENTION

The present invention relates to testing of cigarettes and analogous rod-shaped articles which constitute or form part of smokers' products. Typical examples of such rod-shaped articles are filter rod sections, plain cigarettes, cigars and cigarillos as well as filter cigarettes, cigars and cigarillos. More particularly, the invention relates to improvements in a method of testing rod-shaped articles (hereinafter called cigarettes for short) of the tobacco processing industry for the presence or absence of plural defects.

It is known to test rod-shaped articles of the tobacco processing industry for the presence or absence of two or more different defects. For example, it is known to weigh plain or filter cigarettes in order to ascertain whether the cigarettes are underweight or overweight. Underweight cigarettes are not acceptable to the smoker, and overweight cigarettes are not acceptable to the manufacturer because they contain excessive quantities of the most expensive commodity in cigarette making, namely, tobacco shreds. The testing can be carried out during manufacture or during processing of cigarettes. For example, the mass or weight of cigarettes can be determined by monitoring the mass of successive increments of a continuous cigarette rod prior to subdivision of such rod into discrete rod-shaped articles. Signals from the testing device or devices which serve to ascertain the weight of unit lengths of the rod or the weight of successive discrete cigarettes are compared with reference signals in order to determine whether or not the monitored unit lengths or discrete cigarettes are underweight or overweight. Defective cigarettes, or cigarettes produced from defective portions of the rod, are thereupon segregated from satisfactory cigarettes in order to prevent further processing or entry into the packing machine.

Filter cigarettes are also subjected to numerous tests. Such tests include, for example, ascertaining the condition of wrappers of the tobacco-containing portions, the condition of connections between the tobacco-containing portions and the filter plugs, the hardness or firmness of the tobacco-containing ends, the permeability of the wrappers, the resistance to axial flow of tobacco smoke into the mouth of the smoker, and many others. The wrappers of tobacco-containing portions are examined for the presence or absence of holes, frayed ends of the wrappers, air pockets, open seams and/or a combination of such defects. The same holds true for the testing of uniting bands which are used to connect the tobacco-containing portions of filter cigarettes with the respective filter plugs. Many manufacturers also employ testing devices which monitor the exterior of the articles for the presence or absence of smudges and for the condition of imprints representing the trademark(s), the brand name and/or the name of the manufacturer.

Many conventional testing devices are fully automated and are incorporated into cigarette making or processing machines so that each and every cigarette is tested for the presence or absence of the particular defect or defects. The testing devices are designed to generate defect signals which are transmitted to a suitable ejecting device serving to segregate defective cigarettes from satisfactory cigarettes and to propel, deposit or cause gravitational descent of segregated cigarettes into a collecting receptacle. If a machine embodies two or more testing devices, the defect signals which are generated by such plural devices are transmitted to a single ejector which segregates defective articles at a given location without "knowing" the exact nature of defects which have caused the segregation of such cigarettes from satisfactory cigarettes. As a rule, the ejector comprises a nozzle which receives blasts of compressed air to eject the defective cigarettes from their flutes or other receiving means and to propel the ejected articles into the aforementioned common receptacle.

The just discussed mode of plural testing and subsequent segregation of defective cigarettes exhibits numerous defects. One of the main drawbacks of such conventional procedures is that they do not take advantage of all possibilities which are offered by ejection of defective cigarettes, especially as regards the causes of defects, the condition of testing devices, the condition of the machine or machines wherein the testing devices are put to use, the possibility of rapidly ascertaining the cause or causes of defects, and the possibility of rapidly curing or eliminating the causes of defects such as improper operation of the machine and/or testing equipment.

OBJECTS AND SUMMARY OF THE INVENTION

An object of the invention is to provide a novel and improved method of utilizing the results of multiple testing of cigarettes or the like.

Another object of the invention is to provide a method which renders it possible to rapidly ascertain the causes of defects in cigarettes or the like and to ascertain the order of urgency in which such causes must be eliminated.

A further object of the invention is to provide a method of multiple testing of cigarettes or the like which enables the attendants to inspect, compare and otherwise evaluate the results of tests at any stage of operation of the machine or machines which produce and/or process the articles.

An additional object of the invention is to provide a method of multiple testing of cigarettes or the like which allows for evaluation of the condition and/or mode of operation of testing instrumentalities at any desired stage of operation of the machine or machines in which the testing instrumentalities are used.

Another object of the invention is to provide a method which, in addition to multiple testing of plain or filter cigarettes or analogous rod-shaped articles, allows for removal of desired numbers of samples and automatic return to normal operation as soon as a selected number of samples are gathered at a location which permits for convenient removal of samples from the machine.

Still another object of the invention is to provide a method which allows for evaluation of any desired practical number of tests in a small area and with resort to relatively simple and reliable instrumentalities.

The invention resides in the provision of a method of testing and classifying cigarettes or analogous rod-shaped articles which constitute or form part of smokers' products. The method comprises the steps of subjecting, at a first station, the articles to a plurality of different tests each of which involves monitoring the articles for the presence or absence of one of a variety of defects and generating different defect signals on detection of the respective defects so that each of these signals denotes a different type of defect, transporting the tested satisfactory and defective articles along a common path from the first station toward a second station for accumulation of defective articles, and delaying the defect signals for intervals of time corresponding to those which are required to transport the respective (defective) articles from the first to the second station. At least one of the tests can be carried out during the making of the articles or during processing of the articles (for example, at least one of the tests can be carried out in a cigarette maker and at least one additional test can be carried out in a filter tipping machine which is connected to and receives plain cigarettes from the maker). The tests preferably comprise monitoring at least two different characteristics of articles at the first station, generating different first signals each of which is indicative of the respective characteristic of the monitored article, comparing the different first signals with different reference signals which are indicative of acceptable characteristics of the corresponding type, and generating the aforementioned defect signals when the first signals deviate from the respective reference signals to a predetermined extent (i.e., to an extent which warrants the assumption, or which clearly indicates, that the respective article exhibits the particular defect).

The method can further comprise the step of segregating the defective articles from satisfactory articles in the common path in response to the respective delayed defect signals so that each delayed defect signal initiates the segregation of that article which has caused the generation of such defect signal. The just mentioned segregating step can be followed by or may include the step of accumulating the segregated defective articles into groups in each of which the articles exhibit identical defects. Otherwise stated, the method can comprise the step of establishing and maintaining at the second station a gathering zone for each type of defective articles so that each of these zones accumulates articles exhibiting identical defects. This can be achieved, in a relatively simple manner, by introducing defective articles into different receptacles each of which is designed for storage of articles exhibiting a particular defect (such as a hole in the wrapper of a cigarette, a soft tobacco-containing end in a plain or filter cigarette, an underweight cigarette, an overweight cigarette, a filter cigarette wherein the filter plug is not sealingly connected with the tobacco-containing portion, a filter cigarette wherein the so-called ventilation zone exhibits excessive or insufficient permeability to air, and so forth).

In accordance with a presently preferred embodiment of the method, the transporting step includes advancing satisfactory and defective articles along the common path toward but short of the second station and the segregating step comprises removing defective articles from the common path at a third station which is remote from the second station. The segregating step then further comprises (or the method further comprises) the step of advancing defective articles from the third to the second station. Such advancing step can comprise introducing defective articles into discrete receiving means of a conveyor (e.g., into the axially parallel peripheral flutes of a rotary drum-shaped conveyor) and transferring each of the articles from its receiving means into one of several receptacles which are located at the second station so that each receptacle gathers articles exhibiting the same type of defect but different receptacles gather articles exhibiting different defects.

One of the tests can include monitoring the wrappers of plain or filter cigarettes, cigars or cigarillos, or the wrappers of filter rod sections. Alternatively, one of the tests can include monitoring the ends of the articles (e.g., to detect those plain or filter cigarettes wherein the tobacco-containing ends are devoid of tobacco or contain less than a satisfactory quantity of tobacco shreds). One of the tests can include monitoring the weight of the articles in order to detect overweight or underweight articles. Still further, one of the tests can include monitoring the connections between plural coaxial sections of articles, such as the connections which are established by adhesive-coated uniting bands between the filter plugs and tobacco-containing portions of filter cigarettes, cigars or cigarillos. Also, one of the tests can involve ascertaining the permeability of the wrappers of plain or filter cigarettes (especially the permeability of those portions of the wrappers of filter cigarettes which are perforated on purpose in order to establish so-called ventilation zones for admission of cool atmospheric air into the column of tobacco smoke).

The method can further comprise the steps of generating additional signals denoting selected articles (e.g., only satisfactory articles or a shorter or longer series containing a predetermined number of articles including randomly distributed satisfactory and defective articles), and utilizing the additional signals for removal of the corresponding articles during transport away from the first station, e.g., at the second station where the thus removed articles can be gathered in a separate receptacle for use as samples which are examined from time to time to enable the person in charge to ascertain the quality or condition of testing instrumentalities or for other purposes.

The tests can be carried out in close proximity to one another or at a considerable distance from one another, e.g., in a cigarette maker and in a filter tipping machine which receives plain cigarettes from the cigarette maker. The transporting step can include advancing the defective articles all the way to the second station at a predetermined speed (which may but need not vary), and the delaying step then comprises delaying the defect signals as a function of such speed. As a rule, or at least in many instances, the tested articles will contain natural or reconstituted or artificial tobacco; however, and as mentioned above, it is equally possible to resort to the improved method in connection with the production and/or processing of filter rod sections or other types of filters (such as multiplex filters and/or others).

The novel features which are considered as characteristic of the invention are set forth in particular in the appended claims. The improved method itself, however, together with additional features and advantages thereof, will be best understood upon perusal of the following detailed description of certain specific embodiments of apparatus for the practice of the method with reference to the accompanying drawing.

DESCRIPTION OF THE PREFERRED EMBODIMENTS

Figure 2:
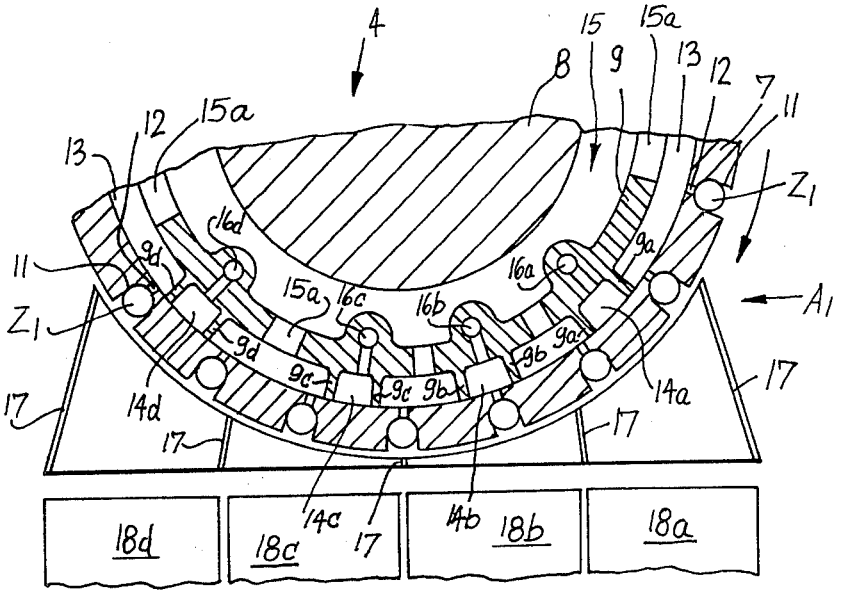
FIG. 2 is a greatly enlarged fragmentary sectional view as seen in the direction of arrows from the line II—II of FIG. 1, showing a portion of a conveyor which transports satisfactory and defective cigarettes, as well as several receptacles which are disposed at a segregating station and serve to gather articles exhibiting different types of defects.
Figure 1:
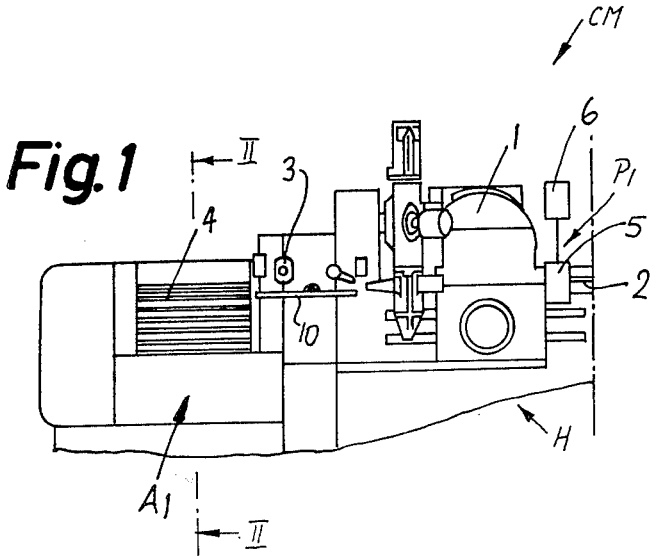
FIG. 1 is a fragmentary elevational view of a portion of a cigarette maker incorporating an apparatus which is constructed and assembled for the practice of one embodiment of the novel method.
Figure 3:
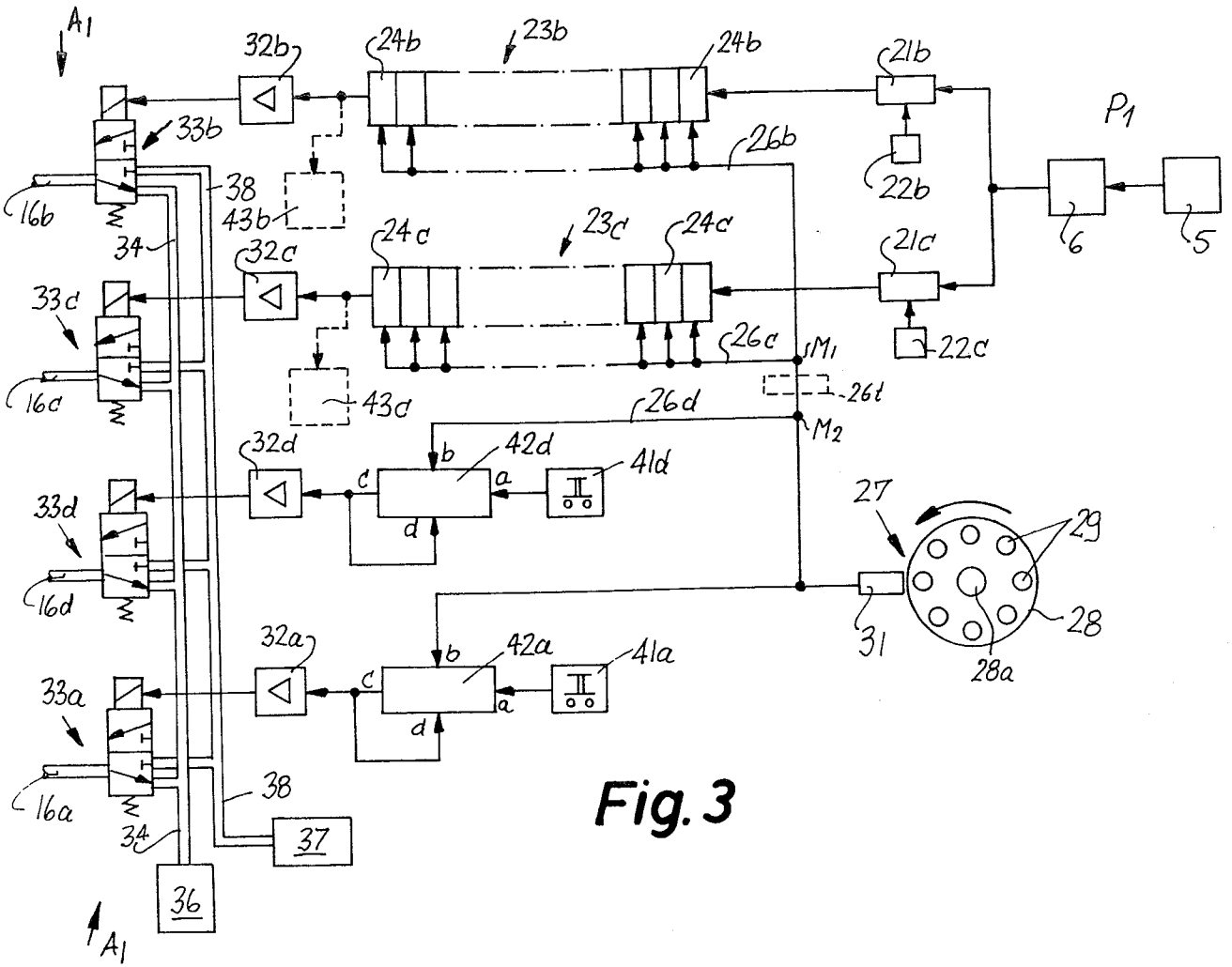
FIG. 3 is a circuit diagram showing the construction of means for delayed transmission of defect signals to the segregating station of FIG. 2.

FIGS. 1 to 3 illustrate a first embodiment of an apparatus which is designed to detect and segregate defective plain cigarettes Z1 during manufacture, namely in a cigarette maker CM of the type known as GARANT and manufactured and sold by the assignee of the present application. FIG. 1 merely shows a portion of the maker CM; an entire maker of similar design is disclosed, for example, in commonly owned U.S. Pat. No. 4,281,670 granted Aug. 28, 1981 to Uwe Heitmann et al. The disclosure of this patent, as well as of each hereafter mentioned United States patent, is incorporated herein by reference. That portion of the maker CM which is shown in FIG. 1 comprises a frame of housing H which supports a severing device 1 of the type commonly known as cutoff and whose function is to sever a continuous cigarette rod 2 at regular intervals so as to convert the rod into a single file of discrete plain cigarettes Z1 (FIG. 2) of unit length. The mass or weight of individual cigarettes Z1 is determined by a testing device 5 which is adjacent to the path of the cigarette rod 2 and includes a signal generator 6 serving to transmit electric signals denoting the weight of successive unit lengths of the rod 2, namely, the weight of unit lengths which are converted into discrete cigarettes Z1 by the orbiting knife or knives of the cutoff 1. The testing device 5 is adjacent to a first portion (testing station) P1 of the path along which the cigarettes Z1 advance (prior and subsequent to their separation from one another) toward a second (segregating) station A1 which is shown in detail FIG. 2 and wherein the defective cigarettes Z1 are classified according to their defects.

The cigarettes Z1 which are obtained by severing the leader of the rod 2 (such rod contains a continuous tubular filler consisting of natural tobacco, reconstituted tobacco and/or substitute tobacco, and a tubular wrapper of cigarette paper or the like which is draped around the filler and whose overlapping marginal portions are bonded to each other by a suitable adhesive to form an elongated seam extending in parallelism with the axis of the rod) are introduced into and advance along an elongated prismatic trough 10 into the range of a driven rotary accelerating cam 3 whose lobe or lobes propel successive (randomly distributed satisfactory and defective) cigarettes Z1 into successive axially parallel peripheral flutes 11 of a rotary drum-shaped transporting conveyor 4 which advances the satisfactory and defective cigarettes along a common path toward the portion or station A1 where the defective cigarettes are segregated from satisfactory cigarettes. Satisfactory cigarettes Z1 do not leave their path and are advanced to one or more processing stations, normally into a filter tipping machine, e.g., a machine FT of the type shown in FIG. 4. In the machine FT, pairs of satisfactory cigarettes Z1 are united with filter plugs of double unit length to form filter cigarettes of double unit length in a manner to be described in connection with FIG. 4.

The testing device 5 which monitors the mass or weight of successive unit lengths of the tobacco filler in the wrapper of the cigarette rod 2 may be of a well known type, for example, a device employing a source of corpuscular radiation (such as a beta ray emitter) and an ionization chamber (5) whose output signal is indicative of the mass of the measured or monitored unit length of the filler. If the momentary values of the output signal are added up, e.g., by resort to a suitable integrating circuit, one readily obtains signals which denote the weight or mass of selected lengths of the filler, preferably lengths corresponding to that of the filler in a plain cigarette Z1. A testing device embodying a source of corpuscular radiation, an ionization chamber and an integrating circuit is disclosed, for example, in commonly owned U.S. Pat. No. 4,024,394 granted May 17, 1977 to Joachim Reuland.

The output signals of the signal generator 6 are compared with reference signals (this will be described with reference to the circuit of FIG. 3) which are indicative of acceptable weight or mass of the cigarettes Z1. The cigarettes Z1 which are overweight or underweight are segregated at the station A1, i.e., they are removed from the flutes 11 of the conveyor 4 in predetermined portions of the common path for defective and satisfactory cigarettes so that the underweight cigarettes can enter a first common receptacle and the overweight cigarettes can enter a second common receptacle. This ensures that each receptacle gathers only those defective cigarettes which exhibit a common defect.

FIG. 2 shows the details of a portion of the transporting conveyor 4 as well as the details of the station A1 which gathers defective cigarettes according to their respective defects. The conveyor 4 comprises a cylindrical rotor 7 whose peripheral surface is formed with the aforementioned axially parallel flutes 11 each adapted to receive and retain a cigarette Z1 during transport to or toward, past and beyond the station A1. The rotor 7 is rotatable about the axis of a horizontal shaft 8 and surrounds a stationary cylindrical control element 9 in the form of a so-called valve plate serving to regulate the admission of compressed air into or evacuation of air from selected flutes 11. To this end, the flutes 11 communicate with ports 12 in the form of radial bores which are machined into the rotor 7 and communicate with a suction chamber 13 when the cigarettes Z1 in the respective flutes 11 are to advance with the rotor 7. The suction chamber 13 is of annular shape and is disposed between the internal surface of the rotor 7 and the exterior of the valve plate 9. This chamber communicates, in turn, with a main or second suction chamber 15 which is always maintained at subatmospheric pressure and can communicate with the suction chamber 13 by way of apertures or cutouts 15*a* in the valve plate 9. The exterior of the valve plate 9 is formed with pairs of radially outwardly extending partitions in the form of webs 9a, 9b, 9c and 9d which subdivide a portion of the chamber 9 into four discrete compartments 14a, 14b, 14c and 14d. The top lands of the partitions 9a–9d are in sealing engagement with the internal surface of the rotor 7 or are sufficiently close to such internal surface to prevent pronounced leakage of gaseous fluid (air) between such compartments and the suction chamber 13. The compartments 14a to 14d are connected with discrete segregating units, here shown as electromagnetic valves 33a, 33b, 33c, 33d (FIG. 3), by conduits 16a, 16b, 16c and 16d. Each electromagnetic valve can connect the respective compartment with a source 37 of compressed gaseous fluid (normally air) or with a suction generating device 36, depending upon whether the cigarettes Z1 in the flute 11 which communicates with the corresponding compartment (via one or more ports 12) is to be ejected from or retained on the rotor 7.

The lower portion of the rotor 7 of the transporting conveyor 4 is adjacent to sheet metal guides 17 which are designed to direct the segregated defective cigarettes Z1 into the respective receptacles 18a, 18b, 18c, 18d. At least two of these receptacles are designed to gather cigarettes exhibiting a particular defect. For example, one of the receptacles 18a to 18d will gather underweight cigarettes and another of these receptacles will gather overweight cigarettes.

The circuit of FIG. 3 is designed to regulate the operation of the electromagnets 33a to 33d and hence the retention or expulsion of cigarettes Z1 during travel past the segregating station A1. The circuit of FIG. 3 processes the signals which are transmitted by the signal generator 6 of the testing device 5. Furthermore, this circuit comprises means for delaying the defect signals to thereby ensure that each defect signal reaches the corresponding electromagnet at the exact moment when the cigarette Z1 which has caused the generation of such defect signal is ready to be introduced into the appropriate receptacle 18a, 18b, 18c or 18d. The means for delaying the defect signals are designed to delay such signals in synchronism with the speed of travel of defective cigarettes from the station P1 to the station A1.

The signals which are furnished by the signal generator 6 of the testing device 5 are transmitted to the first inputs of two conventional signal comparing units 21b and 21c whose second inputs respectively receive reference signals from two discrete sources 22b and 22c (each such source can constitute an adjustable potentiometer). Each of the signals which are transmitted by the signal generator 6 is assumed to denote the mass or density of a predetermined length of the filler in the rod 2, namely, the mass or density of the filler in a cigarette Z1. If the signal from 6 is indicative of an underweight cigarette Z1, the output of the unit 21b transmits a signal to the first stage 24b of a shift register 23b which constitutes a means for delaying defect signals denoting underweight cigarettes. The output of the signal comparing unit 21b transmits a signal only when the intensity or another characteristic of the signal from 6 is less than the intensity or another characteristic of the reference signal which is transmitted by the source 22b. The stages 24b of the shift register 23b are further connected to the output of a timing pulse generator 27 which transmits such pulses at a rate proportional to the speed of travel of cigarettes Z1 from the station P1 toward the station A1. As shown in FIG. 3, the timing pulse generator 27 can comprise a disc-shaped carrier 28 for an annulus of permanent magnets or other suitable signal generating elements 29 which advance past a stationary proximity detector switch 31 arranged to transmit to each stage 24b a signal-transporting pulse in response to passage of an element 29 therealong. The conductor means connecting the output of the proximity detector switch 31 with the lower inputs (as viewed in FIG. 3) of the stages 24b is denoted by the reference character 26b. Each of the intervals at which the proximity detector switch 31 generates pulses corresponds to that which is required to advance a cigarette Z1 from the place occupied by a next-following flute 11 to the place occupied by the preceding flute 11 of the transporting conveyor 4. In other words, the spacing between the neighboring signal generating elements 29 on the disc 28 is proportional to the spacing between neighboring cigarettes Z1 in the common path extending from the station P1 toward the station A1. Otherwise stated, and since the shaft 28a of the disc 28 is driven by the prime mover of the maker CM (the same as the rotor 7), the delay which is effected by the shift register 23b in connection with defect signals denoting underweight cigarettes is proportional to the speed of the cigarette maker.

The number of stages 24b in the shift register 23b corresponds to the number of cigarettes Z1 in the path portion between the testing device 5 and the compartment 14b intermediate the rotor 7 and the valve plate 9. The reason is that the receptacle 18b is designated to receive defective (underweight) cigarettes Z1 during travel of the corresponding flutes 11 past the compartment 14b. Thus, if the signal which the testing device 5 (and more particularly its signal generator 6) transmits during travel of an underweight section of the rod 2 past the station P1 is indicative of the fact that the cigarette Z1 which is about to be produced by separating such underweight section from the remainder of the rod 2 contains less than the required minimum acceptable mass of tobacco particles, the output of the signal comparing stage 21b transmits a defect signal to the first stage 24b of the shift register 23b, and the pulses which are transmitted via conductor means 26b transport such defect signal toward the last stage 24b of the shift register 23b at the same speed at which the corresponding (underweight) cigarette Z1 advances from the station P1 toward the stationary compartment 14b. The thus delayed defect signal reaches the last stage 24b of the shift register 23b and is amplified by an amplifier 32b prior to reaching the solenoid of the valve 33b. Prior to application of such signal to the solenoid, the valving element of the valve 33b is held in a position in which the associated conduit 16b is free to communicate with the suction generating device 36 (e.g., a suitable suction fan whose intake is connected to a conduit 34 connecting the device 36 with all four electromagnetic valves 33a to 33d). This means that the compartment 14b is maintained at a pressure which is below atmospheric pressure and such subatmospheric pressure is communicated to the flutes 11 which travel therealong because successive flutes communicate with the compartment 14b by way of the respective ports 12. However, once the solenoid of the electromagnetic valve 33b is energized, the valving element of this valve seals the conduit 16b from the conduit 34 (i.e., from the suction generating device 36) and connects the conduit 16b with a conduit 38 which is connected to the outlet of the source 37 of compressed air (e.g., with the outlet of a blower or the like). This means that the compartment 14b receives compressed air and such air issues via ports 12 communicating with the oncoming flute 11 which contains the respective defective cigarette Z1, i.e., that cigarette whose testing by the device 5 at the station P1 has initiated the generation of the aforediscussed defect signal (such defect signal was delayed during travel through successive stages 24*b* of the shift register 23*b*). The jets of compressed air expel the underweight cigarette Z1 from its flute 11 at the exact moment when such flute is disposed between the guides 17 flanking the open upper end of the receptacle 18*b* for accumulation of underweight cigarettes.

The manner in which the overweight cigarettes Z1 are gathered in the receptacle 18*c* is analogous. Thus, a signal which is generated at 6 and is indicative of an overweight cigarette Z1 is transmitted by the output of the signal comparing unit 21*c* (the source 22*c* is adjusted to transmit reference signals denoting the upper limit of acceptable weight of a cigarette Z1), and such defect signal is delayed during travel from stage to stage 24*c* of a second shift register 23*c* whose last stage transmits defect signals to the solenoid of the electromagnetic valve 33*c* by way of an amplifier 32*c*. The stages 24*c* receive signal advancing pulses from the switch 31 by way of conductor means 26*c*. The valving element of the valve 33*c* normally connects the conduit 16*c* with the conduit 34; however, when the solenoid of the valve 33*c* is energized, the valving element of this valve connects the conduit 16*c* with the conduit 38 so that the compartment 14*c* receives compressed air and initiates the ejection of the overweight cigarette Z1 into the receptacle 18*c*. The receptacle 18*c* gathers only those cigarettes Z1 which exhibit a particular defect, namely, all overweight cigarettes.

Satisfactory cigarettes Z1 (i.e., those which are neither underweight nor overweight) are free to advance past and beyond the receptacles 18*b* and 18*c* because their monitoring at the station P1 does not entail the generation of defect signals by the signal comparing stage 21*b* or 21*c* so that the valves 33*b* and 33*c* continue to connect the compartments 14*b* and 14*c* with the suction generating device 36 and the satisfactory cigarettes are attracted to the rotor 7 during travel above the open ends of the receptacles 18*b* and 18*c*.

It is desirable, from time to time, to remove a predetermined number of cigarettes Z1 whose weight or mass is satisfactory or has been found to be satisfactory by the heretofore described parts of the circuit shown in FIG. 3. To this end, the circuit of FIG. 3 comprises a manually operated switch 41*d* whose actuation by an attendant initiates the transmission of a signal to the input a of an adjustable counter 42*d*. Transmission of a signal to its input a activates the counter 42*d* so that the latter begins to accept and count the number of pulses which are transmitted to its input b by the timing pulse generator 27 via conductor means 26*d*. The output c of the counter 42*d* transmits a signal in response to reception of a pulse at the input b, and such signals are amplified at 32*d* prior to energizing the solenoid of the electromagnetic valve 33*d* which normally connects the conduit 16*d* (and hence the compartment 14*d*) with the suction generating device 36 via conduit 34. However, when the solenoid of the valve 33*d* is energized, the valving element of this valve connects the conduit 16*d* with the conduit 38 so that the cigarettes Z1 which advance past the compartment 14*d* are expelled into the respective receptacle 18*d* by jets of compressed air entering the ports 12 which advance along the compartment 14*d*.

When the input b receives a preselected number of pulses, the last of the signals which are transmitted to the amplifier 32*d*, and which are also transmitted to the resetting input d of the counter 42*d*, causes the counter to cease the transmission of signals to the amplifier 32*d* because the receptacle 18*d* has accumulated the preselected number of cigarettes Z1. The number of (satisfactory) cigarettes Z1 in the receptacle 18*d* will be less than the preselected number if the series of cigarettes in the path upstream of the compartment 14*d* contains one or more defective (underweight or overweight) cigarettes because such defective cigarettes are segregated by expelling them into the receptacle 18*b* or 18*c* both of which, in the embodiment shown in FIG. 2, are located ahead of the receptacle 18*d*. In other words, the number of cigarettes which are gathered in the receptacle 18*d* in response to a selected setting of the counter 42*d* will be less than the number corresponding to such setting; however, this is of no consequence in most instances because, as a rule, the number of (sample) cigarettes which are removed in response to actuation of the switch 41*d* must merely approximate a given number. Furthermore, and if the actuation of switch 41*d* is to initiate the removal of a predetermined number of cigarettes Z1 (irrespective of the condition of the removed cigarettes), it is merely necessary to provide in the conductor means 26*b* a switch upstream of the tap M1 but downstream of the tap M2 to prevent the transmission of pulses from the proximity detector switch 31 of the timing pulse generator 27 to the shift registers 23*b* and 23*c* while such pulses are free to reach the input b of the counter 42*d*. The just mentioned switch (shown at 26*t*) can be opened by actuating the switch 41*d* and closed in response to transmission of the last of a preselected number of signals to the resetting input d of the counter 42*d*.

The same results can be achieved by placing the receptacle 18*d* ahead of the receptacles 18*b* and 18*d*, as considered in the direction of rotation of the rotor 7.

Still further, similar results can be obtained by installing in the conductor means 26*d* a suitable device (such as a conventional logic circuit) which blocks the transmission of a pulse from the switch 31 to the input b of the counter 42*d* when a defect signal is transmitted to the first stage 24*b* of the shift register 23*b* or to the first stage 24*c* of the shift register 23*c*. This ensures that the number of samples which are gathered in the receptacle 18*d* matches the number which is selected by the setting of the counter 42*d*, as well as that each cigarette which enters the receptacle 18*d* is neither underweight nor overweight. The two last discussed modifications exhibit the advantage that the receptacle 18*d* accumulates only those cigarettes which are free of defects of the type indicated by defect signals furnished by the signal comparing unit 21*b* or 21*c*.

It is further clear that the apparatus which is shown in FIGS. 1 to 3 is not limited to detection and segregation of cigarettes which are defective because they are either overweight or underweight. On the contrary, such apparatus can be used for detection and separate accumulation of cigarettes Z1 which exhibit one or more further defects without in any way departing from the spirit of the invention. For example, the apparatus of FIGS. 1 to 3 can further embody a testing device of the type disclosed in commonly owned U.S. Pat. No. 3,951,267 granted Apr. 20, 1976 to Joachim Reuland and adapted to monitor the compactness or hardness of one or both ends of each cigarette Z1. Also, the improved apparatus can embody a testing device which monitors the position and the quality of imprints on the wrappers of cigarettes (the imprints are normally applied by bronze powder and can denote the name of the manufacturer, the trademark or trademarks of the manufacturer and/or the brand name of the product). A suitable testing device is disclosed in U.S. Pat. No. 3,688,620 granted Sept. 5, 1972 to Richard C. Harris, Jr. Still further, a testing device can be designed to monitor the wrappers of cigarettes Z1 for other types of defects (such as holes, open seams, frayed ends, smudges at the exterior of wrappers and/or others). A testing device which is capable of generating signals in response to detection of some or all of such defects is disclosed, for example, in commonly owned U.S. Pat. No. 3,962,906 granted June 15, 1976 to Uwe Heitmann et al. The just discussed testing devices can be provided in addition to or in lieu of the testing device 5, depending upon the likelihood of occurrence of particular defects in a given maker.

The apparatus of FIGS. 1 to 3 is further designed to allow for withdrawal of samples irrespective of whether or not the withdrawn cigarettes are overweight or exhibit other types of defects. To this end, the circuit of FIG. 3 comprises a further manually actuatable switch 41*a* which can transmit an energizing signal to the input a of an adjustable counter 42*a*. The latter is analogous to the aforediscussed counter 42*d*, i.e., its input b receives pulses from the switch 31 of the timing pulse generator 27, its output c transmits a signal to the solenoid of the electromagnetic valve 33*a* via amplifier 32*a* whenever its input b receives a pulse, and its resetting input d deactivates the counter 41*d* when it receives the last of a predetermined number of signals transmitted by the output c. The valving element of the valve 33*a* normally connects the conduit 16*a* with the conduit 34, i.e., the compartment 14*a* is normally connected with the suction generating device 36 so that plain cigarettes in the flutes 11 moving past the compartment 14*a* normally remain in such flutes and advance toward the compartment 14*b*. However, when the solenoid of the valve 33*a* is energized, the valving element of this valve seals the conduit 16*a* from the conduit 34 and connects the conduit 16*a* with the conduit 38 so that each of a selected number of randomly distributed satisfactory and defective plain cigarettes Z1 is expelled into the receptacle 18*a*. The ejection of such cigarettes is terminated when the resetting input d of the counter 42*a* receives the last of a predetermined number of signals. An examination of cigarettes which gather in the receptacle 18*a* will reveal the number of underweight or overweight cigarettes in a batch containing a predetermined number of cigarettes. Also, an evaluation of cigarettes which are gathered in the receptacle 18*a* enables the person in charge to ascertain whether or not the testing device 5 operates properly. An examination of cigarettes in the receptacle 18*b* or 18*c* also enables the person in charge to ascertain whether or not the operation of the testing device 5 is proper. Thus, if the cigarettes Z1 which are removed for examination from the receptacle 18*b* are not underweight, the operation of the signal generator 6 and/or signal comparing unit 21*b* is unsatisfactory. Analogously, if the cigarettes which are removed from the receptacle 18*c* are not overweight, the operation of the signal generator 6 and/or signal comparing unit 21*c* must be unsatisfactory.

Removal of samples is desirable in many instances. For example, such samples will be removed when the machine is converted from the making of a first type or brand of cigarettes to the making of a different brand. Also, the person in charge may wish to remove a number of samples when the machine is started after a relatively long period of idleness or while the machine is being repaired.

The number of underweight cigarettes Z1 can be ascertained by a counter 43*b* (shown in FIG. 3 by broken lines) which receives signals from the last stage 24*b* of the shift register 23*b*. A similar counter 43*c* (connected to the last stage 24*c* of the shift register 23*c*) can be provided to count the number of overweight cigarettes. The counters 43*b* and 43*c* are indicated by broken lines because they are optional. In many instances, it will suffice to provide a single counter which receives signals from the outputs of the shift registers 23*b* and 23*c* so as to furnish an indication as to the combined number of overweight and underweight cigarettes.

Figure 4:
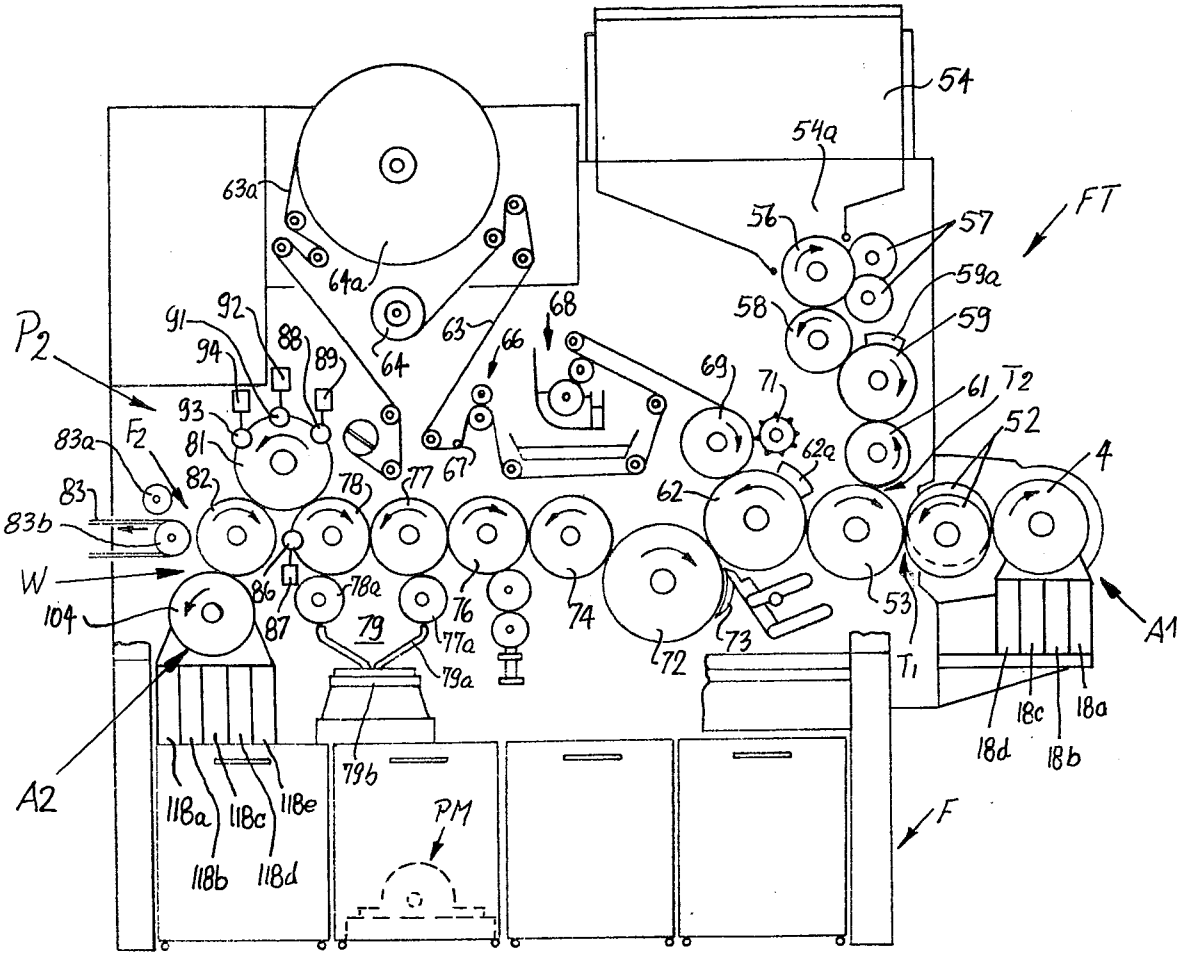
FIG. 4 is a schematic front elevational view of a filter tipping machine which receives plain cigarettes from the machine of FIG. 1 by way of the conveyor of FIG. 2 and a second apparatus.
Figure 5:
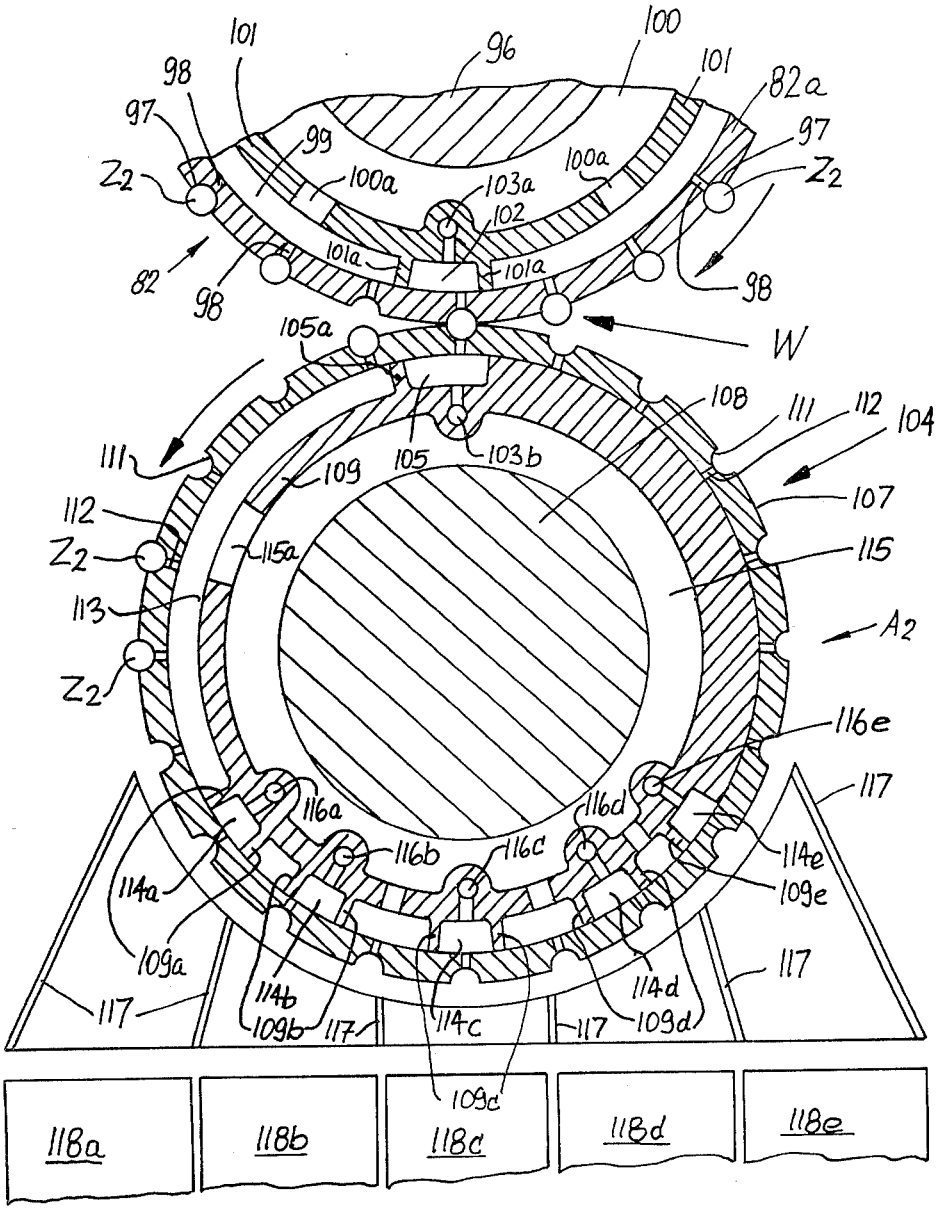
FIG. 5 is a sectional view of two conveyors in the apparatus of FIG. 4, further showing several receptacles for the gathering of defective articles exhibiting different types of defects.
Figure 6:
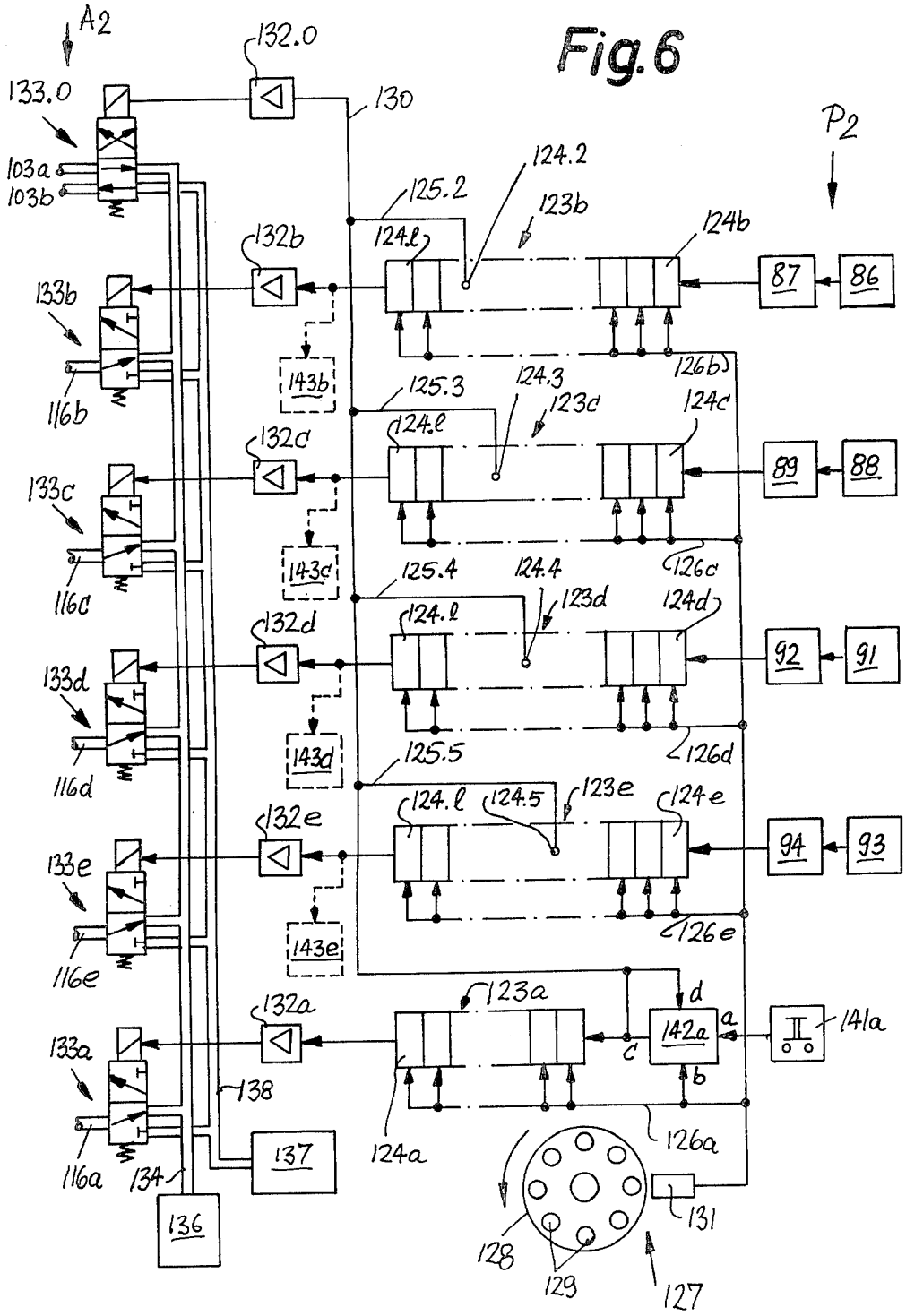
FIG. 6 is a circuit diagram of the means for delaying defect signals which are transmitted from the testing devices in the apparatus of FIG. 4 to the segregating means for transfer of defective articles into corresponding receptacles.

FIGS. 4, 5 and 6 illustrate a second embodiment of the apparatus which is installed in the frame F of the filter tipping machine FT, namely, in a machine which processes plain cigarettes Z1 furnished by the cigarette maker CM of FIG. 1. The machine of FIG. 4 is known in the trade as MAX-S and is manufactured and sold by the assignee of the present application. The transporting conveyor 4 and the four receptacles 18*a* to 18*d* for the gathering of samples and/or defective cigarettes Z1 are shown in the right-hand portion of FIG. 4. The conveyor 4 delivers satisfactory plain cigarettes Z1 to a pair of rotary drum-shaped aligning conveyors 52. The arrangement is preferably such that the flutes 11 of the rotor 7 forming part of the transporting conveyor 4 form two rows of plain cigarettes Z1, namely, a first row which is adjacent to one axial end of the conveyor 4 and whose cigarettes are held in the oddly numbered flutes 11, and a second rod which is adjacent to the other axial end of the conveyor 4 and whose cigarettes are held in the evenly numbered flutes 11. Each of the aligning conveyors 52 receives the cigarettes of one of these rows, and the distances through which the conveyors 52 transport the respective cigarettes and/or the speeds of the aligning conveyors are selected in such a way that these conveyors deliver pairs of coaxial but spaced-apart cigarettes Z1 into successive axially parallel flutes of a rotary drum-shaped assembly conveyor 53. The introduction of pairs of coaxial cigarettes Z1 into the flutes of the conveyor 53 takes place at a transfer station T1. The width of gaps between the cigarettes Z1 of each pair at the station T1 at least equals but normally exceeds the length of a filter plug of double unit length.

It will be noted that the conveyor 4 performs several functions, namely, assisting in segregation of defective plain cigarettes Z1 from satisfactory plain cigarettes, admitting satisfactory plain cigarettes into the filter tipping machine FT, and converting a single file of satisfactory plain cigarettes (coming from the trough 10) into two rows, one for each of the two aligning conveyors 52.

The conveyors 52 and 53 are mounted in the frame F of the filter tipping machine FT and such frame further supports a magazine 54 for a supply of parallel filter rod sections of six times unit length. The filter rod sections extend at right angles to the plane of FIG. 4, the same as the plain cigarettes Z1 in the flutes of the conveyors 52 and 53, and descend through the outlet 54*a* of the magazine 54 into successive axially parallel peripheral flutes of a rotary drum-shaped cutting conveyor 56 cooperating with two rotary disc-shaped knives 57 to subdivide each filter rod section of six times unit length into three coaxial filter plugs of double unit length. The thus obtained sets of three coaxial filter plugs each are transferred onto a rotary staggering conveyor 58 which staggers the originally coaxial filter plugs of each set, as considered in the circumferential direction of the components of the conveyor 58, and delivers successive individual filter plugs into successive peripheral flutes of a rotary drum-shaped shuffling conveyor 59. The latter cooperates with one or two stationary cams 59*a* to shift some or all of the filter plugs axially and to thus convert the series of staggered filter plugs into a single row wherein each preceding filter plug is in exact alignment with the next-following filter plug. Successive filter plugs of such single row are transferred, by a rotary drum-shaped accelerating and inserting conveyor 61, into successive flutes of the assembly conveyor 53 (at a second transfer station T2) in such positions that they are received in the spaces between successive pairs of plain cigarettes Z1 which are delivered by the aligning conveyors 52 at the transfer station T1. Thus, each such flute of the assembly conveyor 53 which advances beyond the transfer station T1 contains a group of three coaxial rod-shaped articles (namely, two coaxial but spaced-apart plain cigarettes Z1 of unit length and a filter plug of double unit length therebetween), and such groups are transferred into successive axially parallel peripheral flutes of a rotary drum-shaped transfer conveyor 62 cooperating with one or two stationary condensing cams 62*a* which ensure that one or both plain cigarettes of each group are shifted axially toward the respective filter plug in order to eliminate clearances, if any, between the two end faces of the filter plugs and the adjacent cigarettes.

The frame F of the filter tipping machine FT further supports an expiring reel 64 consisting of a convoluted web 63 of tipping paper (such as cigarette paper or artificial cork) which is drawn by two advancing rolls 66 at least one of which is driven to move successive increments of the running web 63 past the relatively sharp edge of a curling device 67 of the type disclosed in commonly owned U.S. Pat. No. 3,962,957 granted June 15, 1976 to Alfred Hinzmann. A fresh reel 64*a* is held in a position of readiness so that the leader of its web 63*a* can be spliced to the running web 63 shortly prior to expiration of the supply of tipping paper on the core of the reel 64. A splicing device which can be used in the machine of FIG. 4 is disclosed in commonly owned U.S. Pat. No. 3,730,811 granted May 1, 1973 to Gerd-Joachim Wendt.

The running web 63 advances beyond the nip of the rolls 66 and one of its sides is coated with a layer of suitable adhesive during travel along a paster 68. The leader of the web 63 adheres to the peripheral surface of a rotary suction drum 69 which cooperates with the knives of a cutting drum 71 to subdivide the leader of the web 63 into discrete uniting bands. Such uniting bands are attached to successive groups of coaxial articles on the transfer conveyor 62 so that each uniting band adheres to the corresponding filter plug as well as to the adjacent end portions of the respective plain cigarettes.

Successive groups, each of which carries an adhesive-coated uniting band, are thereupon transferred onto a rotary drum-shaped draping conveyor 72 which cooperates with a stationary or mobile rolling device 73 (e.g., a device of the type disclosed in commonly owned U.S. Pat. Nos. 3,483,873 and 3,527,234 both granted to Alfred Hinzmann on Dec. 16, 1969 and Sept. 8, 1970, respectively) to convolute successive uniting bands around the corresponding groups so that each such group is converted into a filter cigarette of double unit length. Successive filter cigarettes of double unit length are transferred onto a rotary drum-shaped drying or heating conveyor 74 which promotes the setting of adhesive at the inner sides of convoluted uniting bands before the filter cigarettes are transferred onto a rotary drum-shaped severing conveyor 76 which cooperates with a rotary disc-shaped knife 75 to subdivide each filter cigarette of double unit length into two filter cigarettes Z2 (see FIG. 5) of unit length. The severing plane extends midway across the filter plugs of successive filter cigarettes of double unit length so that the single row of filter cigarettes of double unit length is converted into two parallel rows of filter cigarettes of unit length whereby the filter plugs of filter cigarettes in one of the two rows are adjacent to the filter plugs of cigarettes in the other of the two rows. The severing conveyor 76 transports the cigarettes of the two rows sideways (i.e., at right angles to the axes of such cigarettes) and in the direction indicated by the arrow. At the same time, the severing conveyor 76 includes, constitutes or cooperates with means for segregating defective filter cigarettes of double unit length or unit length from satisfactory cigarettes, e.g., by permitting filter cigarettes without plain cigarettes or without filter plugs to descend by gravity into a suitable collecting receptacle, not shown.

The severing conveyor 76 delivers the two rows of filter cigarettes of unit length to the rotary drum-shaped conveyor 77 of a tip turning or inverting device 79 which inverts the filter cigarettes of one row end-for-end and places the inverted cigarettes between the cigarettes of the non-inverted row so as to form a single row of cigarettes wherein the filter plugs of all cigarettes face in the same direction. The device 79 further comprises a second rotary drum-shaped conveyor 77*a* which receives the one row from the conveyor 77 and delivers successive filter cigarettes of the one row to successive orbiting arms 79*a* which are driven by a motor or transmission 79*b* and invert the cigarettes end-for-end prior to delivery into successive flutes of a rotary drum-shaped conveyor 78*a*. The latter delivers the inverted cigarettes into alternate flutes of a rotary drum-shaped conveyor 78. The remaining flutes of the conveyor 78 receive non-inverted filter cigarettes of unit length directly from the conveyor 77. Thus, the conveyor 78 transports a single row consisting of alternating inverted and non-inverted filter cigarettes of unit length. The conveyor 78 constitutes a testing conveyor or, more specifically, a means for transporting successive filter cigarettes of unit length past a first testing device 86 having a signal generator 87. Successive filter cigarettes of the single row on the conveyor 78 are delivered to a second testing conveyor 81 which forms part of or cooperates with three additional testing devices 88, 91, 93 respectively having signal generators 89, 92 and 94. The conveyors 78 and 81 are disposed at a testing station P2 with four testing devices.

The turn-around device 79 may be of the type disclosed in commonly owned U.S. Pat. No. 3,583,546 granted June 4, 1971 to Gerhard Koop.

Satisfactory and defective filter cigarettes Z2 of unit length are transported beyond the testing station P2 by a conveyor arrangement F2 including a rotary drum-shaped conveyor 82 which delivers satisfactory (defect-free) cigarettes onto the upper reach of a belt conveyor 83 cooperating with a braking roller 83*a* and trained over pulleys 83*b* (only one shown). The upper reach of the belt conveyor 83 delivers satisfactory filter cigarettes Z2 to storage, into a reservoir system (e.g., a system known as RESY and manufactured and sold by the assignee of the present application) or directly to a packing machine, e.g., a machine of the type known as COMPAS (manufactured and sold by the assignee of the present application). Defective filter cigarettes Z2 leave the common path (defined by the conveyor 82) in the region of a switching device W and are delivered onto a segregating and classifying conveyor 104 which is analogous to the conveyor 4 of FIG. 2 and is located at a classifying and segregating station A2. The conveyor 104 can also receive samples (including only satisfactory filter cigarettes Z2 or randomly distributed satisfactory and defective filter cigarettes Z2) for delivery into one of five gathering receptacles 118*a*, 118*b*, 118*c*, 118*d* and 118*e* at the station A2.

The conveyor 78 can be of the type disclosed in the commonly owned U.S. Pat. No. 3,993,194 granted Nov. 23, 1976 to Joachim Reuland. This conveyor serves to transport satisfactory and defective filter cigarettes Z2 of unit length past the testing device 86 which monitors the tobacco-containing ends of the cigarettes and whose signal generator 87 generates an electric signal whenever a filter cigarette Z2 passes therealong. Such signals are compared with appropriate reference signals denoting satisfactory tobacco-containing ends, and the comparison results in the generation of a defect signal when the signal which is generated as a result of monitoring the end of a cigarette deviates from the reference signal to a predetermined extent, i.e., when the monitored end is unsatisfactory. As described in U.S. Pat. No. 3,993,194 to Reuland, the testing device 86 can constitute a capacitive testing device and the signal comparing means can be incorporated in this testing device so that the signal generator 87 transmits a (defect) signal only when the device has monitored a filter cigarette Z2 with a defective end.

The testing device 88 serves to monitor the wrappers of successive filter cigarettes Z2 of unit length in order to ascertain the presence or absence of leaks (open seams, holes, frayed ends, unsatisfactory connections between the filter plugs and tobacco-containing portions and/or similar defects). It is assumed that the testing device 88 is designed to monitor only the wrappers of the tobacco-containing portions of successive filter cigarettes Z2 of unit length. The testing device 91 is designed to monitor the permeability of the wrappers of successive filter cigarettes Z2, especially in the regions of the so-called ventilation zones which are normally provided in the wrappers of filter plugs or tobacco-containing portions close to the locus of abutment of the filter plug against the tobacco-containing portion. The purpose of ventilating zones is to allow a certain amount of atmospheric air to penetrate into the column of tobacco smoke when the cigarette is lighted and the smoker draws smoke into his or her mouth. It is believed that admission of cool atmospheric air into the tobacco smoke reduces the presumably deleterious effects of nicotine and/or tar and/or condensate upon the lungs of the smoker. An apparatus which can make perforations in filter cigarettes in order to establish the just discussed ventilating zones is disclosed, for example, in commonly owned U.S. Pat. No. 4,282,889 granted Aug. 11, 1981 of Rolf Dahlgrün. As concerns the construction of the testing device 91, reference may be had to commonly owned U.S. Pat. No. 4,177,670 granted Dec. 11, 1979 to Uwe Heitmann et al. (especially to FIGS. 4 and 5 of this patent).

The testing device 93 is designed to monitor the condition of connections (normally established by the aforediscussed uniting bands) between the filter plugs and the tobacco-containing portions or sections of successive filter cigarettes Z2 of unit length. A testing device of such type is disclosed, for example, in U.S. Pat. No. 4,020,675 granted May 3, 1977 to Ivan Y. Hirsh. The patented testing apparatus is capable of ascertaining the presence or absence of leaks in the regions where the convoluted uniting bands surround the filter plugs and the adjacent end portions of tobacco-containing sections of the filter cigarettes.

While FIG. 4 shows a single conveyor 81 for the transport of filter cigarettes Z2 past three testing devices (88, 91, 93), it is equally within the purview of the invention to employ a discrete conveyor for each of these testing devices or to provide two conveyors one of which transports filter cigarettes past two testing devices and the other of which transports filter cigarettes past the third testing device.

FIG. 5 illustrates a portion of the conveyor 82 which transports filter cigarettes Z2 past the testing devices 88, 91, 93 and the combined segregating and classifying conveyor 104 which receives defective filter cigarettes from the conveyor 82 via switching device W. The conveyor 82 has a cylindrical rotor 82*a* which is mounted for rotation about a horizontal shaft 96 and whose peripheral surface is formed with axially parallel article-receiving flutes 97 each of which can accommodate a portion of a defective filter cigarette for delivery to one of the receptacles 118*a* to 118*e* or a portion of a satisfactory cigarette for delivery to the receptacle which gathers samples of satisfactory cigarettes or samples of cigarettes irrespective of their quality. The flutes 97 communicate with radial ports 98 which are machined into the rotor 82*a* and normally communicate with an annular suction chamber 99 serving to ensure that a cigarette Z2 in the corresponding flute 97 adheres to and moves with the rotor 82*a*. The suction chamber 99 surrounds a stationary cylindrical valve plate 101. The latter surrounds an annular main suction chamber 100 which surrounds the stationary shaft 96 and communicates with the suction chamber 99 by way of apertures in the form of slots or cutouts 100*a* machined into the valve plate 101. The suction chamber 100 is permanently connected with a suitable suction generating device so that the pressure therein is always below atmospheric pressure. The same holds true for those portions of the outer suction chamber 99 which communicate with the suction chamber 100 via slots 100*a*.

The valve plate 101 has two radially outwardly extending partitions 101*a* in the form of ribs or webs whose top lands contact or are closely adjacent to the internal surface of the rotor 82*a* and which define between themselves a chamber or compartment 102, this compartment constituting or forming part of the aforementioned switching device W whose function is to transfer satisfactory and/or defective filter cigarettes Z2 from the respective flutes 97 of the rotor 82*a* into the oncoming flutes 111 of a cylindrical rotor 107 forming part of the combined segregating and classifying conveyor 104. The compartment 102 communicates with a conduit 103*a* which can be connected with a suction generating device 136 or with a source 137 of compressed air by way of an electromagnetic valve 133.0 shown in the upper left-hand portion of FIG. 6. The solenoid of the valve 133.0 normally connects the conduit 103*a* with the suction generating device 136 (via conduit 134 shown in FIG. 6) in order to ensure that all satisfactory filter cigarettes Z2 of unit length can advance beyond the switching device W to be deposited on the upper reach of the belt conveyor 83. When energized, the solenoid of the valve 133.0 connects the conduit 103*a* with the source 137 of compressed air by way of a conduit 138 (shown in FIG. 6) in order to ensure that the switching device W transfers the arriving defective cigarette Z2 from the respective flute 97 into the oncoming flute 111 of the rotor 107.

The rotor 107 of the conveyor 104 is coaxial with and can turn about a stationary horizontal shaft 108 which is secured to the frame F, the same as the shaft 96. The axially parallel peripheral article-receiving flutes 111 of the rotor 107 communicate with radially inwardly extending ports or bores 112 which further communicate with an arcuate suction chamber 113 during travel beyond the switching device W so that defective cigarettes Z2 which have entered the respective flutes 111 adhere to the rotor 107 while the latter rotates in a counterclockwise direction, as viewed in FIG. 5. The rotor 82*a* of the conveyor 82 also rotates in a counterclockwsie direction and at the peripheral speed of the rotor 107. The suction chamber 113 communicates with an inner suction chamber 115 which is disposed between the peripheral surface of the shaft 108 and the internal surface of a stationary cylindrical valve plate 109. The latter has slots or cutouts 155*a* establishing communication between the suction chambers 113 and 115. The suction chamber 115 is permanently connected with a suitable suction generating device, not shown.

That portion of the valve plate 109 which is adjacent to the nip of the rotors 82*a* and 107 has a radially outwardly extending axially parallel rib or web 105*a* bounding a portion of a chamber or compartment 105 (the illustrated compartment is a groove machined into the peripheral surface of the valve plate 109 and extending in parallelism with the axis of the conveyor 104) which is connected with a conduit 103*b*. As shown in FIG. 6, the conduit 103*b* is also connected with the electromagnetic valve 133.0, the same as the conduit 103*a* which communicates with the compartment 102 at the other side of the nip of the rotors 82*a* and 107. The arrangement is such that the valving element of the valve 133.0 connects the conduit 103*b* with the source 137 of compressed air when the conduit 103*a* is connected with the suction generating device 136, and vice versa. Thus, when a satisfactory cigarette Z2 is in the process of moving through the nip of the rotors 82*a*, 107, the port or ports 112 which communicate with the compartment 105 normally discharge compressed air while the port or ports 98 which communicate with the compartment 102 normally draw air from the respective flutes 97 so that the satisfactory cigarette is even more likely to remain in the flute 97 and to advance toward and onto the upper reach of the belt conveyor 83. On the other hand, when the flute 97 which advances past the compartment 102 contains a defective cigarette Z2 (because such cigarette has been found to be defective by the testing device 86, 88, 91 or 93), the corresponding port or ports 98 receive compressed air from the source 137 via compartment 102 and the corresponding port or ports 112 (in communication with the compartment 105) are connected with the suction generating device 136 to even more reliably ensure the transfer of such defective cigarette into the adjacent flute 111 of the rotor 107.

The valve plate 109 is further formed with partitions in the form of radially outwardly extending axially parallel ribs or webs 109*a*, 109*b*, 109*c*, 109*d*, 109*e* serving to subdivide the respective portion of the suction chamber 113 into five compartments or chambers 114*a*, 114*b*, 114*c*, 114*d* and 114*e* which are adjacent to the open tops of the respective receptacles 118*a*, 118*b*, 118*c*, 118*d* and 118*e* at the segregating and classifying station A2. The compartments 114*a* to 114*e* are respectively connected with five electromagnetic valves 133*a*, 133*b*, 133*c*, 133*d* and 133*e* (all shown in FIG. 6) by conduits 116*a*, 116*b*, 116*c*, 116*d* and 116*e*. The valves 133*a*–133*e* normally connect the conduits 116*a*–116*e* and the respective compartments 114*a*–114*e* with the suction generating device 136. However, if the solenoid of one of these valves is energized, the corresponding conduit 116*a*, 116*b*, 116*c*, 116*d* or 116*e* is connected with the source 137 of compressed air. Sheet metal or plastic guides 117 are disposed between the lower portion of the rotor 107 and the receptacles 118*a*–118*e* to ensure that the filter cigarettes Z2 which leave the respective flutes 111 in the region of the compartment 114*a* enter the receptacle 118*a*, that the filter cigarettes which leave their flutes 111 in the region of the compartment 114*b* enter the receptacle 118*b*, and so forth.

If desired, the conveyor 104 can be placed further away from the manufacturing or processing stations in the machine FT. In such apparatus, the delivery of defective cigarettes Z2 from the conveyor 82 onto the conveyor 104 takes place by way of one or more intermediate conveyors in the form of drums, fluted endless belts, chains with cradles or the like. The distance between the common path for the satisfactory and defective cigarettes Z2 and the station A2 depends on the availability of space for the receptacles 118*a* to 118*e*. All of these receptacles need not be immediately adjacent to each other; this also depends on the availability of space at the station A2. If necessary, there can be provided two classifying stations one of which accommodates a first number of gathering receptacles and the other of which accommodates the remaining receptacles.

Referring to FIG. 6, the circuit which is shown therein serves for the processing or evaluation of signals which are transmitted by the signal generators 87, 89, 92 and 94. This circuit generates defect signals of four different types each of which is indicative of a different defect, and such defect signals are utilized in order to ensure that each of the receptacles provided at the station A2 for accumulation of defective cigarettes gathers only those defective cigarettes which exhibit the same type of defect. The circuit of FIG. 6 further comprises time delay devices which delay the transmission of signals to the switching device W and to the compartments 114*a* to 114*e* in synchronism with the transport of defective cigarettes Z2 to the station A2.

The signal generator 87 is assumed to include a transducer as well as a signal comparing unit and a source of reference signals so that the signal which is transmitted to the first stage 124*b* of a time delay device (shift register) 123*b* is a defect signal. In other words, the just mentioned transducer generates signals which are indicative of the respective characteristic (density of the tobacco-containing end) of successive cigarettes Z2 advancing with the conveyor 78 from the conveyors 77, 78*a* toward the conveyor 81. Such signals are compared with reference signals denoting the minimum acceptable density of tobacco-containing ends, and the signal comparing unit of the testing device 86 transmits a defect signal to the first stage 124*b* of the shift register 123*b* when the intensity or another characteristic of the signal which is generated by the transducer does not match the corresponding characteristic of the reference signal. The stages of the shift register 123*b* receive signal transporting pulses from the proximity detector switch 131 of a timing pulse generator 127 which is analogous to the pulse generator 27 of FIG. 3 and further comprises a disc 128 which is driven by the prime mover PM of the filter tipping machine FT (such prime mover can drive the machines CM and TM) and carries an annulus of permanent magnets 129 or other suitable signal generating elements which cause the switch 131 to transmit a pulse whenever one of such elements advances therealong. The output of the switch 131 is connected with the stages of the shift register 123*b* by conductor means 126*b*. The frequency at which the switch 131 transmits pulses is selected in such a way that the length of each interval between two successive pulses corresponds to the length of the interval which elapses while a next-following cigarette Z2 advances through a distance needed to occupy the place previously occupied by the preceding cigarette. This can be readily achieved by appropriate selection of the spacing between neighboring signal generating elements 129 on the disc 128 of the timing pulse generator 127. It will be seen that the time delay which is effected by the shift register 123*b* is proportional to the speed of the filter tipping machine FT. The number of stages 124*b* in the shift register 123*b* corresponds to the number of cigarettes in the path between the testing device 86 and the compartment 114*b* of the suction chamber 113 in the conveyor 104. Thus, if a filter cigarette Z2 which is located at the testing station P2 and is being monitored by the testing device 86 causes the signal generator 87 to transmit a defect signal to the first stage 124*b* of the shift register 123*b* (because the tobacco-containing end of such cigarette is unsatisfactory, normally too soft), the shift register 123*b* delays the transmission of such signal to the solenoid of the electromagnetic valve 133*b* for an interval of time which matches the interval of travel of the respective filter cigarette from the testing device 86 to the space above the open top of the receptacle 118*b*, i.e., at a level below the compartment 114*b*. When the defective cigarette Z2 (namely, the cigarette whose tobacco-containing end is too soft and which has caused the testing device 86 to generate a defect signal) reaches the station A2, the corresponding defect signal is transmitted by the last stage 124.1 of the shift register 123*b*, is amplified by an amplifier 132*b* and is transmitted to the solenoid of the valve 133*b*. Up to such time, the valving element of the valve 133*b* was held in a position such that the conduit 116*b* was free to connect the compartment 114*b* with the suction generating device 136 via conduit 134, i.e., filter cigarettes Z2 between the compartment 114*b* and the receptacle 118*b* were free to advance toward the compartment 114*c* because the port or ports 112 in communication with the respective flute 111 were connected to the suction generating device 136. However, energization of the solenoid of the valve 133*b* causes the respective valving element to connect the conduit 116*b* with the source 137 of compressed air via conduit 138 so that the flute 111 carrying the defective cigarette Z2 receives one or more streams of compressed air by way of the corresponding port or ports 112 and the defective cigarette is propelled into the associated receptacle 118*b*. Thus, each cigarette Z2 which has been found to be defective by the testing device 86 automatically enters the receptacle 118*b*.

Prior to reaching a flute 111 of the rotor 107, the just discussed defective cigarette Z2 must be transferred from the rotor 82*a* of the conveyor 82 onto the rotor 107 of the conveyor 104, i.e., the switching device W must be activated to expel the defective cigarette from its flute 97 and to ensure that such cigarette enters and remains in the oncoming flute 111 during transport into the space between the compartment 114*b* and the receptacle 118*b*. To this end, an amplifier 132.0 for signals which are to be transmitted to the solenoid of the electromagnetic valve 133.0 is connected with an intermediate stage 124.2 of the shift register 123*b* by conductor means 125.2 and 130. The number of stages between the first or foremost stage 124*b* and the stage 124.2 of the shift register 123*b* corresponds to the number of cigarettes Z2 in the common path for satisfactory and defective cigarettes Z2 between the testing device 86 and the switching device W. Otherwise stated, the number of shift register stages between the stages 124.2 and 124.1 corresponds to the number of flutes 111 between the switching device W and the compartment 114*b*. Thus, when the defective cigarette whose examination has caused the testing device 86 to generate a defect signal reaches the space between the chambers or compartments 102 and 105, the solenoid of the valve 133.0 cause the valving element of this valve to connect the conduit 103*a* with the source 137 of compressed air while, at the same time, connecting the conduit 103*b* to the suction generating device 136 with the result that the defective cigarette is automatically transferred from its flute 97 into the registering flute 111 and begins to advance with the rotor 107 of the conveyor 104. Those stages of the shift register 123*b* which are located between the stages 124.2 and 124.1 thereupon delay the defect signal on its way to the amplifier 132*b* and solenoid of the valve 133*b* so that the defective cigarette Z2 reaches the space between the compartment 114*b* and the receptacle 118*b* at the exact moment when the solenoid of the valve 133*b* is energized.

The manner in which the defect signals which are generated by the testing devices 88 (defects of wrappers of tobacco-containing portions of cigarettes Z2), 91 (unsatisfactory permeability of the ventilation zones) and 92 (defects in connections between the filter plugs and plain cigarettes of the filter cigarettes Z2) are processed is analogous to the aforedescribed manner of processing defect signals furnished by the signal generator 87 of the testing device 86. Each of the signal generators 89, 92 and 94 is assumed to contain a transducer, a signal comparing unit and a source of reference signals so that the signals which are transmitted to the first stages 124*c*, 124*d*, 124*e* of the respective time delay means (shift registers) 123*c*, 123*d*, 123*e* are defect signals which initiate the introduction of the respective (defective) cigarettes into the corresponding receptacles 118*c*, 118*d*, 118*e*. The ejection is initiated on transmission of respective defect signals from the last stages 124.1 of the shift registers 123*c*, 123*d*, 123*e* via amplifiers 132*c*, 132*d*, 132*e* to the solenoids of the respective electromagnetic valves 133*c*, 133*d*, 133*e*. This causes the valving elements of these valves to connect the corresponding conduits 116*c*, 116*d*, 116*e* with the source 137 of compressed air, i.e., the conduits 116*c*, 116*d*, 116*e* are disconnected from the conduit 134 and are connected with the conduit 138 to thus ensure that the respective compartments 114*c*, 114*d*, 114*e* are filled with compressed air at the time the cigarettes exhibiting the corresponding defects arrive into the spaces between such compartments and the respective receptacles 118*c*, 118*d*, 118*e*. The receptacle 118*c* gathers only those filter cigarettes Z2 wherein the wrappers of the tobacco-containing portions (namely, the wrappers of plain cigarettes Z1) exhibit one or more holes, open seams or like defects; the receptacle 118*d* gathers only those filter cigarettes Z2 whose perforations (ventilation zones) are unsatisfactory, and the receptacle 118*e* gathers only those filter cigarettes Z2 wherein the connections between the filter plugs and the tobacco-containing portions are defective.

The transfer of the just-discussed defective filter cigarettes Z2 (which are to be admitted into the receptacle 118*c*, 118*d* or 118*e*) from the conveyor 82 onto the conveyor 104 takes place in a manner which is analogous to the aforedescribed manner of transferring cigarettes which have been found to be defective during transport past the testing device 86. Thus, the intermediate stages 124.3, 124.4 and 124.5 of the shift registers 123*c*, 123*d* and 123*e* are respectively connected with the amplifier 132.0 for the valve 133.0 by conductor means 125.3, 125.4 and 125.5 (via conductor means 130) to transmit signals at the exact moments when the cigarettes exhibiting the respective defects are located in the region of the switching device W. The number of stages between the stages 124.3 and 124.1 of the shift register 123*c* equals the number of cigarettes (or, more accurately stated, the number of flutes 111) between the switching device W and the open top of the receptacle 118*c*. Analogously, the number of stages between the stages 124.4 and 124.1 of the shift register 123*d* equals the number of flutes 111 between the switching device W and the open top of the receptacle 118*d*, and the number of stages between the stages 124.5 and 124.1 of the shift register 123*e* equals the number of flutes 111 between the switching device W and the open top of the receptacle 118*e*. The stages of the shift registers 123*c*, 123*d* and 123*e* respectively receive signal transporting pulses via conductor means 126*c*, 126*d* and 126*e*. An advantage of the structure which is shown in FIGS. 5 and 6 is that a single switching device W suffices to effect the transfer of all kinds of defective cigarettes Z2 (as well as of satisfactory cigarettes) from the conveyor 82 onto the conveyor 104.

It will be readily appreciated that the apparatus of FIGS. 4 to 6 is also susceptible of many modifications without departing from the spirit of the invention. Thus, the number of testing devices can be increased or reduced and the aforedescribed testing devices 86, 88, 91 and 93 can be replaced by or combined with other types of testing devices. The number of testing devices which can be employed is practically unlimited. Merely by way of example, one of the testing devices or an additional testing device may be of the type disclosed in commonly owned U.S. Pat. No. 3,395,570 granted Aug.6, 1968 to Horst Kochalski and describing means for detecting those filter cigarettes whose hardness is unsatisfactory, and another testing device which can be used in addition to or in lieu of one or more illustrated testing devices can serve to detect those filter cigarettes which offer excessive or insufficient resistance to the flow of tobacco smoke therethrough (a testing device which can perform such function is disclosed in the just mentioned U.S. Pat. No. 3,395,570).

It is often desirable or necessary to remove from the filter tipping machine FT a shorter or longer series of samples which are thereupon examined in a laboratory or at another location, for example, to ascertain the condition of various testing devices. Furthermore, it is often desirable or necessary to remove a certain number of samples irrespective of whether they constitute satisfactory or defective filter cigarettes. To this end, the circuit which is shown in FIG. 6 comprises a manually actuatable switch 141*a* which is connected with the input a of an adjustable counter 142*a* having a second input b connected with the switch 131 of the timing pulse generator 127 by a conductor 126*a*, an output c which is connected to the first stage of a shift register 123*a*, and a resetting input d which receives signals transmitted by the output c. The counter 142*a* is activated when its input a receives a signal in response to actuation of the switch 141*a*; its output c then transmits a signal in response to transmission of each pulse to the input b. The signals are delayed by the shift register 123*a* whose stages 124*a* receive signal advancing pulses via conductor means 126*a*, and the signal which is transmitted by the last stage of the shift register 123*a* is amplified at 132*a* prior to application to the solenoid of the electromagnetic valve 133*a* controlling the conduit 116*a* which is connected with the compartment 114*a* above the receptacle 118*a*. The electromagnetic valve 133*a* connects the conduit 116*a* with the source 137 of compressed air (via conduit 138) in response to transmission of a signal from the last stage of the shift register 123*a* whereby the compartment 114*a* receives compressed air and causes expulsion of the cigarette Z2 from the adjacent flute 111 into the receptacle 118*a* therebelow. The number of stages in the shift register 123*a* matches the number of flutes between the switching device W and the receptacle 118*a*. Also, each signal which appears at the output c of the counter 142*a* is transmitted to the amplifier 132.0 so that the valve 133.0 effects the transfer from a flute 97 into the adjacent flute 111 of each cigarette Z2 which is to be deposited in the receptacle 118*a*. The deposition of cigarettes in the receptacle 118*a* is terminated when the resetting input d of the counter 142*a* receives a selected number of signals. This deactivates the counter 142*a* and the valve 133*a* ceases to cause the admission of samples into the receptacle 118*a* at the station A2.

The apparatus of FIGS. 4 to 6 enables the attendants to rapidly ascertain the number of cigarettes exhibiting any one of several defects by the simple expedient of observing the contents of the receptacles 118*b*, 118*c*, 118*d* and 118*e*. If a more accurate determination is required, the circuit of FIG. 6 is equipped with counters 143*b*, 143*c*, 143*d*, 143*e* which are respectively connected with the outputs of the shift registers 123*b*, 123*c*, 123*d* and 123*e* to count the defective cigarettes in the respective receptacles 118*b* to 118*e*. Furthermore, the attendants can rapidly ascertain the ratio of cigarettes exhibiting one of the four different defects to the cigarettes exhibiting other types of defects. All that is necessary is to compare the readings of the counters 143*b* to 143*e*. Still further, and as mentioned above, the apparatus renders it possible to ascertain, whenever desired or necessary, the condition of various testing devices by the simple expedient of examining the cigarettes in the receptacles 118*b* to 118*e* in order to determine whether or not such cigarettes actually exhibit the respective defects and whether or not the defects are sufficiently serious to warrant segregation of the respective cigarettes from those which advance toward the upper reach of the belt conveyor 83. For example, if one of the receptacles 118*b* to 118*e* contains a large or an inordinately large number of defective or presumably defective cigarettes, and if an examination of such cigarettes reveals that their defects are hardly noticeable (i.e., that the defects are non-existent or not sufficiently serious to warrant the segregation of corresponding cigarettes and their introduction into the receptacle 118*b*, 118*c*, 118*d* or 118*e*), the attendant will be alerted to examine the respective testing device 86, 88, 91 or 93 in order to rapidly eliminate the cause of improper testing and to thus save numerous satisfactory cigarettes from segregation by the switching device W. Such procedure is much faster and much simpler than heretofore known and applied methods of ascertaining the condition of testing devices. The conventional methods normally involve removal of samples at relatively long intervals and an examination of removed samples in order to ascertain whether or not they exhibit defects which should have been detected by the respective testing devices. The just mentioned mode of checking the condition of testing devices is cumbersome and unreliable. On the other hand, the apparatus of the present invention practically invites a conscientious attendant to check a particular testing device when the number of defective or presumably defective cigarettes in the receptacle 118*b*, 118*c*, 118*d* and/or 118*e* increases more rapidly than anticipated.

The counters 143*b* to 143*e* are indicated by broken lines because they are optional. There is no need for a counter at the output of the shift register 123*a* because the setting of the counter 142*a* determines the number of samples which are admitted into the receptacles 118*a*.

For the sake of simplicity, the preceding description of the mode of operation of the apparatus shown in FIGS. 4 to 6 disregards the possibility of removal of certain defective plain cigarettes Z1 by the apparatus of FIG. 3, i.e., the possibility that certain filter cigarettes which are formed by convoluting uniting bands around plain cigarettes and filter plugs are incomplete due to the absence of plain cigarettes which are segregated at the station A1. The corresponding defective filter cigarettes are removed from the severing conveyor 76 which, as stated above, can constitute or form part of a testing device serving to ascertain whether or not each filter cigarette arriving on the conveyor 76 actually includes all three of its rod-shaped components, namely, two plain cigarettes of unit length and a filter plug of double unit length.

The apparatus which are respectively shown in FIGS. 1 to 3 and 4 to 6 exhibit the additional important advantage that they do not interfere with orderly manufacture and/or processing of rod-shaped articles. Thus, and since a modern cigarette maker is practically loaded with various devices, aggregates, instruments and other types of equipment for the treatment of components of cigarettes and/or for treatment of finished cigarettes, the receptacles 18*a* to 18*d* are placed into a region where they do not interfere with orderly operation of the cigarette maker CM and/or with orderly transfer of satisfactory plain cigarettes Z1 into the filter tipping machine FT. The utilization of a row-forming conveyor 4 as a means for transferring satisfactory plain cigarettes into the filter tipping machine as well as for delivery of defective cigarettes to the corresponding receptacles at the station A1 contributes to simplicity and compactness of the maker without in any way interfering with its operation and/or affecting the quality of the products. The space below the conveyor 4 is readily available for installation of a desired number of receptacles; furthermore, such receptacles are readily accessible to allow for removal of their contents. The front walls of the receptacles (18*a*–18*d* and/or 118*a*–118*e*) can be made of a light-transmitting material to allow for determination of the number of accumulated articles therein during each and every stage of operation of the respective machine.

The apparatus of FIGS. 4 to 6 also exhibits the just discussed advantages. Thus, the receptacles 118*a* to 118*e* are readily accessible, and the construction of the filter tipping machine FT is simplified due to the fact that the conveyor 82 performs plural functions (delivery of satisfactory cigarettes Z2 to the removing conveyor 83 and delivery of defective cigarettes Z2 to the conveyor 104 for transfer into the corresponding receptacles 118*b* to 118*e*). The space below the conveyor 82 is available for installation of the conveyor 104 as well as for installation of a desired number of receptacles. However, and as mentioned above, the station A2 can be moved further away from the common path of satisfactory and defective cigarettes Z2 by the simple expedient of providing one or more intermediate conveyors between the conveyors 82 and 104. The same holds true for the conveyor 4 and the receptacles 18*a*–18*d*, i.e., one or more additional conveyors can be provided between the conveyor 4 and the receptacles 18*a* to 18*d*, and the additional conveyor which is nearest to the receptacles 18*a* to 18*d* is then constructed to ensure controlled or selective delivery of defective cigarettes Z1 to the corresponding receptacles.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of testing and classifying cigarettes or analogous rod-shaped articles which constitute or form part of smokers' products, comprising the steps of subjecting the articles at a first station to a plurality of different tests each of which involves monitoring the articles for the presence or absence of one of a variety of defects and generating different defect signals on detection of the respective defects so that each of said different defect signals denotes a different type of defect; transporting the tested satisfactory and defective articles from said first station along a common path toward a second station for accumulation of defective articles; delaying the defect signals for intervals of time corresponding to those required to transport the respective defective articles from said first to said second station; and segregating the defective articles from satisfactory articles in said common path in response to the delayed defect signals.

2. The method of claim 1, wherein at least one of said tests is carried out during the making of the articles.

3. The method of claim 1, wherein at least one of said tests is carried out during the processing of the articles.

4. The method of claim 1, wherein said tests comprise monitoring at least two different characteristics of articles at said first station, generating different first signals which are indicative of the respective characteristics of the monitored articles, comparing said different first signals with different reference signals which are indicative of acceptable characteristics of the corresponding type, and generating said defect signals when the first signals deviate from the respective reference signals to a predetermined extent.

5. The method of claim 1, wherein said segregating step comprises utilizing each delayed defect signal to initiate the segregation of that defective article which has caused the generation of such defect signal.

6. The method of claim 5, further comprising the step of accumulating the segregated defective articles at said second station into groups in each of which the articles exhibit identical defects.

7. The method of claim 5, further comprising the step of establishing and maintaining at said second station a discrete gathering zone for each type of defective articles so that each such zone accumulates articles exhibiting identical defects.

8. The method of claim 5, wherein said transporting step comprises moving satisfactory and defective articles along said common path toward but short of said second station, said segregating step including removing defective articles from said common path at a third station which is remote from said second station and further comprising the step of advancing defective articles from said third to said second station.

9. The method of claim 8, wherein said advancing step comprises introducing defective articles into discrete receiving means of a conveyor and transferring each of the articles from the respective receiving means into one of several receptacles located at said second station so that each such receptacle gathers articles exhibiting identical defects.

10. The method according to claim 1 of testing and classifying articles having tubular wrappers, wherein one of said tests comprises monitoring the wrappers of the articles.

11. The method of claim 1, wherein one of said tests comprises monitoring the ends of the articles.

12. The method of claim 1, wherein one of said tests comprises monitoring the weight of the articles.

13. The method according to claim 1 of testing and classifying articles having several coaxial sections and uniting bands which establish connections between such sections, wherein one of said tests comprises monitoring the connections between the sections of the articles.

14. The method of claim 13, wherein the articles comprise filter plugs and tobacco-containing sections.

15. The method according to claim 1 of testing articles having permeable wrappers, wherein one of said tests comprises monitoring the permeability of wrappers of the articles.

16. The method of claim 1, further comprising the steps of generating additional signals denoting selected articles and utilizing such additional signals for removal of the corresponding articles from said path during transport away from said first station.

17. The method of claim 1, wherein said subjecting step includes carrying out said tests in close proximity of one another.

18. The method of claim 1, wherein said transporting step comprises conveying the defective articles all the way to said second station at a predetermined speed and said delaying step comprises delaying said defect signals as a function of such speed.

19. The method of claim 1, wherein the articles contain tobacco.

* * * * *